US008100052B2

(12) United States Patent
Kitazawa et al.

(10) Patent No.: US 8,100,052 B2
(45) Date of Patent: Jan. 24, 2012

(54) PRESS MACHINE INCLUDING BOTTOM DEAD CENTER POSITION CORRECTION CONTROL SECTION

(75) Inventors: Kazuo Kitazawa, Sagamihara (JP); Akira Yamanouchi, Sagamihara (JP)

(73) Assignee: Aida Engineering, Ltd., Sagamihara (JP)

( * ) Notice: Subject to any disclaimer, the term of this patent is extended or adjusted under 35 U.S.C. 154(b) by 352 days.

(21) Appl. No.: 12/436,299

(22) Filed: May 6, 2009

(65) Prior Publication Data

US 2009/0277345 A1 Nov. 12, 2009

(30) Foreign Application Priority Data

May 12, 2008 (JP) ..... 2008-124908

(51) Int. Cl.
*B30B 15/26* (2006.01)

(52) U.S. Cl. ..... 100/35; 100/43

(58) Field of Classification Search ..... 100/43, 100/48, 50, 257, 282, 35; 72/20.1, 441, 446; 83/530, 640

See application file for complete search history.

(56) References Cited

U.S. PATENT DOCUMENTS

| | | | | |
|---|---|---|---|---|
| 4,480,538 | A * | 11/1984 | Yoshida | 100/48 |
| 4,621,517 | A | 11/1986 | Hatanaka et al. | |
| 7,187,996 | B2 * | 3/2007 | Tanaka et al. | 700/206 |
| 2008/0034985 | A1 | 2/2008 | Suzuki et al. | |

FOREIGN PATENT DOCUMENTS

| | | | |
|---|---|---|---|
| EP | 1151851 | A2 | 11/2001 |
| EP | 1321285 | A2 | 6/2003 |
| EP | 1787792 | A1 | 5/2007 |
| EP | 1870231 | A1 | 12/2007 |
| JP | 60-141399 | A | 7/1985 |
| JP | 63-299899 | A | 12/1988 |
| JP | 02-080200 | A | 3/1990 |
| JP | 05-008098 | A | 1/1993 |
| JP | 2003-260598 | A | 9/2003 |

* cited by examiner

*Primary Examiner* — Jimmy T Nguyen
(74) *Attorney, Agent, or Firm* — McDermott Will & Emery LLP

(57) ABSTRACT

A press machine includes a bottom dead center position correction control section, a speed state determination section that determines the actual press speed, a control cycle count setting section, and a mode selection control section that selects a single-cycle control mode when the actual press speed is in a changing state, and selects a set multi-cycle control mode when the actual press speed is in a stable state. The bottom dead center position correction control section performs position correction control corresponding to each press cycle in the single-cycle control mode, and performs position correction control corresponding to each control multi-cycle count set by the control cycle count setting section in the set multi-cycle control mode.

4 Claims, 5 Drawing Sheets

PRESS MACHINE INCLUDING BOTTOM DEAD CENTER POSITION CORRECTION CONTROL SECTION

CROSS-REFERENCE TO RELATED APPLICATION

This application claims the benefit under 35 U.S.C. §119 of Japanese Patent Application No. 2008-124908, filed on May 12, 2008, which is hereby incorporated by reference in its entirety.

BACKGROUND OF THE INVENTION

The present invention relates to a press machine that is configured so that the actual bottom dead center position of a slide can be corrected to the target bottom dead center position while controlling the rotation of an adjustment motor using a bottom dead center position correction control section.

It is important for a press machine that the relative distance (die height) between the bottom surface of a slide (upper die) and the upper surface of a bolster (lower die) be maintained constant. This is because a change in die height directly affects the product accuracy.

However, since a change in slide position occurs due to the press structure, thermal deformation (expansion/contraction) of a mechanical component caused by frictional heat, a change in press speed, and the like, it is difficult to continuously perform a press operation while maintaining a constant die height.

Therefore, a bottom dead center position correction control section is generally provided so that the actual bottom dead center position of the slide is corrected to the target bottom dead center position (i.e., the die height is made constant) while controlling the rotation of an adjustment motor by utilizing electrical signals corresponding to a target value (target bottom dead center position data) and a feedback value (bottom dead center position data detected during a press operation).

When the press speed is in a stable state, the amount of change in slide position due to a change in press speed is small. Therefore, even if the die height has been maintained almost constant before starting position correction control, positive position correction control and negative position correction control may be repeated after starting position correction control. Specifically, position correction control is performed in the same manner as in the case where the die height has changed due to a mechanical disturbance. In this case, control tends to become unstable when performing position correction control corresponding to each press cycle. A hunting phenomenon or an out-of-control state is likely to occur as the press speed increases.

Therefore, a related-art bottom dead center position correction control section (see JP-A-60-141399, for example) utilizes a correction unnecessary range (dead zone) while employing a control method that sets the bottom dead center position of the slide within a relatively wide given range in order to reduce a hunting phenomenon. When the bottom dead center position has fallen outside the given range, the bottom dead center position correction control section prompts the worker to take appropriate measures (manual operation) by raising an alarm.

Specifically, the related-art bottom dead center position correction control section performs position correction control corresponding to each press cycle on the assumption that the press speed has reached the set speed (e.g., 60 SPM) (during press operation) (i.e., the press speed is in a stable state (press operation at a constant set speed). In other words, this approach considers position correction control to be unnecessary during acceleration to the set speed from a stationary state or deceleration from the set speed to a stationary state since a product is not produced.

Another approach adjusts a change in die height that occurs during a stationary (stop) period between the preceding press operation and the current press operation. Specifically, since position correction control during a press operation is difficult, a number of devices that are configured to be able to adjust a change in die height before starting a press operation have been proposed (see JP-A-63-299899, JP-A-2-80200, and JP-A-5-8098, for example).

The user of a high-speed press machine (e.g., 200 to 800 SPM or more) generally desires to produce a press product during a rise period from a low speed (e.g., 200 SPM) to the set speed (e.g., 800 SPM) and a fall period from the set speed to a stationary (stop) state from the point of effectively utilizing the press machine. This particularly applies to a large high-speed press machine of which the press speed changes over a long period (e.g., 30 seconds or more).

However, the related-art bottom dead center position correction control section cannot deal with such a demand. Specifically, the related-art bottom dead center position correction control section cannot mechanically, electrically, and controllably perform position correction control on a large high-speed press machine when the press speed is in a changing state.

The press speed of a high-speed press machine is significantly higher than that of a normal press machine (e.g., 60 SPM) when the press speed is in a stable state. Specifically, the cycle time of the high-speed press machine is very short. Therefore, a novel approach is required to enable stable position correction control.

SUMMARY

According to one aspect of the invention, there is provided a press machine including a bottom dead center position correction control section, the bottom dead center position correction control section performing position correction control that corrects an actual bottom dead center position of a slide to a target bottom dead center position while controlling rotation of an adjustment motor by utilizing target bottom dead center position data and bottom dead center position data detected during a press operation, the press machine comprising:

a speed state determination section that determines whether an actual press speed is in a changing state or a stable state;

a control cycle count setting section that sets a control multi-cycle count; and a mode selection control section that selects a single-cycle control mode when the speed state determination section has determined that the actual press speed is in a changing state, and selects a set multi-cycle control mode when the speed state determination section has determined that the actual press speed is in a stable state, the bottom dead center position correction control section performing the position correction control corresponding to each press cycle when the single-cycle control mode has been selected, and performing the position correction control corresponding to each control multi-cycle count set by the control cycle count setting section when the set multi-cycle control mode has been selected by the mode selection control section.

BRIEF DESCRIPTION OF THE SEVERAL VIEWS OF THE DRAWING

FIG. 4 is a timing chart illustrating a correction control operation and the like.

DETAILED DESCRIPTION OF THE EMBODIMENT

Figure 1:
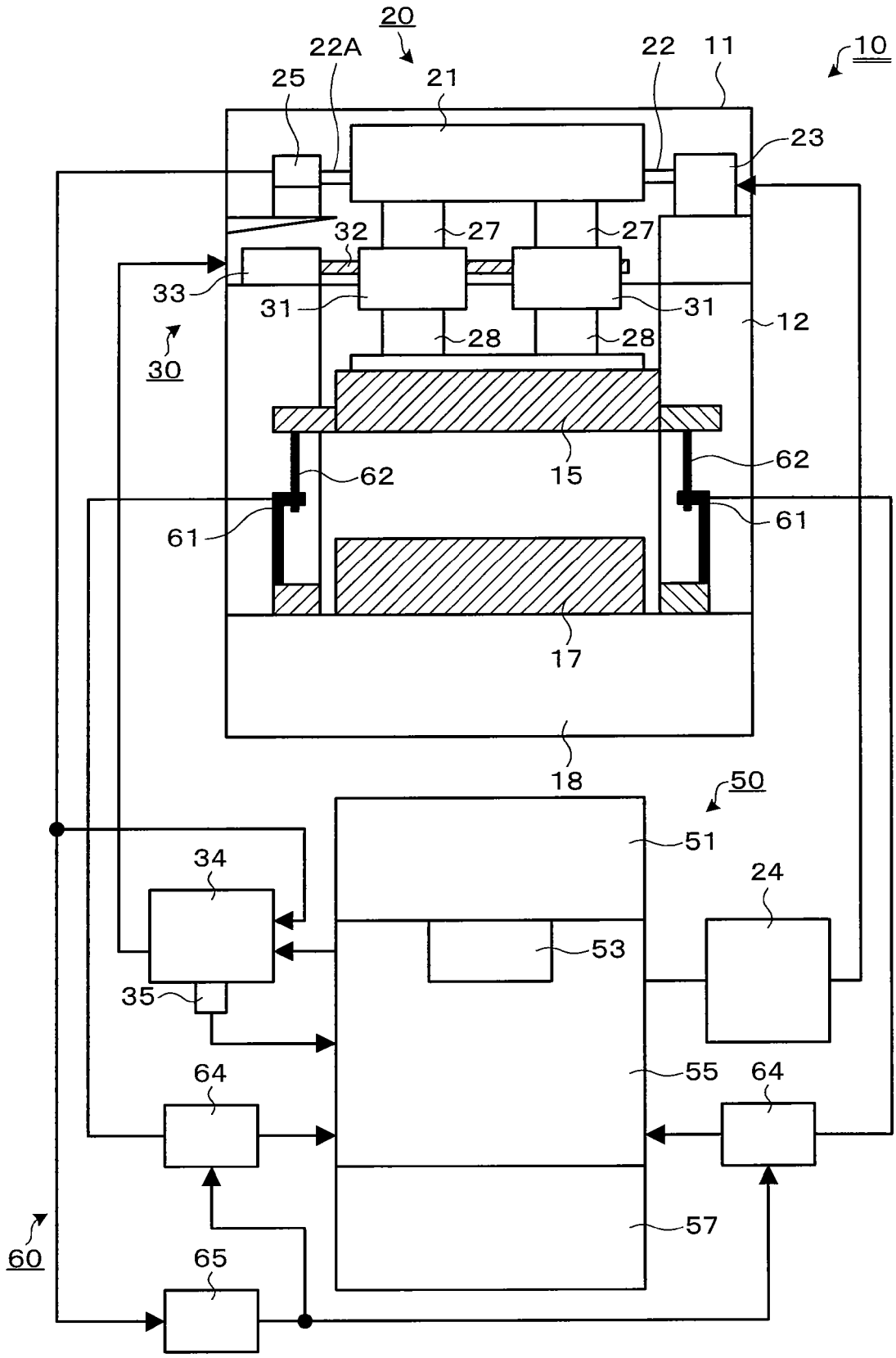
FIG. 1 is a block diagram for describing one embodiment of the invention.

The invention may provide a press machine including a bottom dead center position correction control section that can perform stable position correction control irrespective of whether the press speed is in a changing state or a stable state, and can smoothly and efficiently produce a highly accurate press product.

The invention was conceived based on technical matter characteristic of a high-speed press machine, i.e., the changing state of the press speed is classified as a change in a single direction (acceleration or deceleration) or a bidirectional repeated change (alternating change in positive and negative directions), it was found by experiments that position correction control corresponding to each cycle is very effective for a change in a single direction, a hunting phenomenon easily occurs when performing position correction control corresponding to each cycle when the press speed is in a stable state, and a hunting phenomenon occurs significantly as the press speed increases.

According to one embodiment of the invention, there is provided a press machine including a bottom dead center position correction control section, the bottom dead center position correction control section performing position correction control that corrects an actual bottom dead center position of a slide to a target bottom dead center position while controlling rotation of an adjustment motor by utilizing target bottom dead center position data and bottom dead center position data detected during a press operation, the press machine comprising:

a speed state determination section that determines whether an actual press speed is in a changing state or a stable state;

a control cycle count setting section that sets a control multi-cycle count; and a mode selection control section that selects a single-cycle control mode when the speed state determination section has determined that the actual press speed is in a changing state, and selects a set multi-cycle control mode when the speed state determination section has determined that the actual press speed is in a stable state, the bottom dead center position correction control section performing the position correction control corresponding to each press cycle when the single-cycle control mode has been selected, and performing the position correction control corresponding to each control multi-cycle count set by the control cycle count setting section when the set multi-cycle control mode has been selected by the mode selection control section.

The above press machine can perform stable position correction control irrespective of whether the press speed is in a changing state or a stable state, can minimize a change in bottom dead center position during the press operation, and can smoothly and efficiently produce a highly accurate press product.

The above press machine may further comprise:

an average value calculation cycle count setting section that sets an average value calculation multi-cycle count, wherein a bottom dead center position detected corresponding to a preceding cycle is used as the bottom dead center position data in the single-cycle control mode; and wherein an average value of bottom dead center positions detected corresponding to the average value calculation multi-cycle count set by the average value calculation cycle count setting section is used as the bottom dead center position data in the set multi-cycle control mode, the average value being calculated by an average value calculation control section.

According to this configuration, the control responsiveness when the press speed is in a changing state can be ensured while further improving the control stability when the press speed is in a stable state in addition to achieving the above-described effects.

In the above press machine, the average value calculation cycle count setting section may also serve as the control cycle count setting section; and the average value calculation multi-cycle count may be set to be equal to the control multi-cycle count.

According to this configuration, handling is further facilitated during the actual operation in addition to achieving the above-described effects.

The above press machine may further comprise:

a torque sensor that detects a torque of the adjustment motor; and a torque limit control section that performs torque limit control that is given priority over the position correction control by the bottom dead center position correction control section when the detected torque of the adjustment motor is equal to or larger than a set torque.

According to this configuration, a situation in which an overload state occurs due to mechanical constraint by the press load can be prevented in addition to achieving the above-described effects.

Some Embodiments of the invention are described in detail below with reference to the drawings.

As illustrated in FIGS. 1 to 4, a press machine according to one embodiment of the invention includes a bottom dead center position correction control section 51, 53, a speed state determination section 51, 53, a control cycle count setting section 57, and a mode selection control section 51, 53, wherein the bottom dead center position correction control section 51, 53 can perform position correction control corresponding to each press cycle when a single-cycle control mode has been selected by the mode selection control section, and can perform position correction control corresponding to a multi-cycle count Ncc set using the control cycle count setting section when a set multi-cycle control mode has been selected by the mode selection control section.

Specifically, the bottom dead center position correction control section performs position correction control that corrects the actual bottom dead center position of a slide of the press machine to the target bottom dead center position while controlling the rotation of an adjustment motor by utilizing the target bottom dead center position (data) of the slide and the bottom dead center position (data) detected during a press operation.

In FIG. 1, the main body of a press machine 10 includes a crown 11 that is provided on the upper side, a bed 18 that is provided on the lower side, and a column 12 that is disposed at each corner of the bed 18 and integrally connects the crown 11 and the bed 18. A slide 15 that is movably guided by the column 12 is moved vertically (up and down) by a slide drive mechanism 20. An upper die (not illustrated) is secured on the slide 15, and a lower die (not illustrated) is secured on a bolster 17 placed on the bed 18. The vertical distance between the upper die and the lower die (i.e., the distance between the bottom surface of the slide 15 and the top surface of the bolster 17) is referred to as a die height. It is indispensable to maintain a constant die height in order to ensure the accuracy (quality) of a press product.

The slide drive mechanism 20 includes a crank mechanism (including a crank shaft and a connecting rod) 21 disposed in the crown 11. The slide 15 can be moved up and down by vertically moving a pair of drive shafts (i.e., an upper drive shaft 27 and a lower drive shaft 28) in synchronization by driving a drive motor 23 that is connected to the crank shaft 22 directly or indirectly (i.e., through a speed reducer).

The drive motor 23 is driven based on a drive signal output from a driver 24. The drive signal corresponds to a signal that corresponds to a press speed SPM set using a touch panel 57 (i.e., a press speed instruction signal input to the driver 24 from a control section 51 through an input/output section 55). In FIG. 1, a feedback signal input to the driver 24 is omitted.

Figure 5:
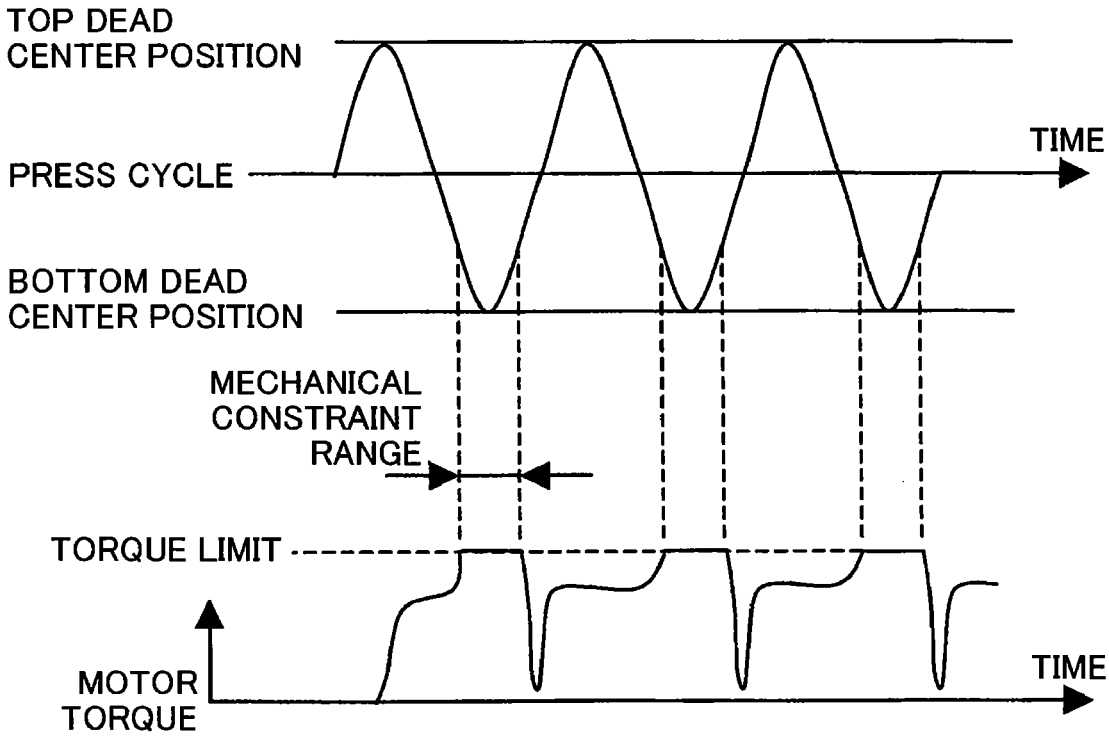
FIG. 5 is a timing chart illustrating a torque limit operation.

The slide 15 is moved up and down between the top dead center position and the bottom dead center position of the crank mechanism 21 (see FIG. 5). In this embodiment, the drive motor 23 can be driven up to a set press speed (e.g., 800 SPM) within a given acceleration time (e.g., 150 seconds) from a state in which the slide 15 is stopped at the top dead center position, for example. The deceleration time is almost the same (150 seconds) as the acceleration time.

An encoder 25 that detects the rotational angle of the crank shaft 22 is provided on the other end (shaft) 22A of the crank shaft 22. The press speed SPM and the current vertical position (e.g., the bottom dead center position) of the slide 15 can be detected by subjecting the rotational angle detected by the encoder 25 to signal processing.

The structure and the configuration of the press machine 10 are not particularly limited. The slide drive mechanism is not limited to the crank mechanism 21 employed in this embodiment. Another structure (e.g., eccentric drive mechanism, link drive mechanism, or screw drive mechanism) by which the amount (thrusting amount) of change in the bottom dead center position of the slide 15 tends to increase as the press speed increases, may be similarly applied to the invention.

In this case, the top dead center position and the bottom dead center position of the crank mechanism 21 respectively refer to the uppermost position and the lowermost position of the slide 15.

A slide position adjustment mechanism 30 includes a mechanical section (including a worm wheel, a spline structural section, and the like) 31 disposed in the crown 11. The relative positions of the upper drive shaft 27 and the lower drive shaft 28 (i.e., the position of the bottom surface of the slide 15) in the vertical direction can be adjusted by driving the adjustment motor 33 to rotate a worm screw shaft 32.

The vertical position of the lower drive shaft 28 with respect to the upper drive shaft 27 can be changed by the slide position adjustment mechanism 30 even when the drive shaft (i.e., the upper drive shaft 27 and the lower drive shaft 28) is moved up and down by the crank mechanism 21 so that the amount of adjustment by the mechanical section 31 can be added to or subtracted from the slide position that depends on the crank mechanism 21.

In this embodiment, the adjustment motor 33 is a three-phase alternating-current servomotor. The rotation of the adjustment motor 33 is controlled based on a drive control signal output from a position control section 34. The drive control signal is generated and output as a signal corresponding to a deviation signal that is obtained by utilizing target bottom dead center position data (target value) that is set using the touch panel 57 and is input through the input/output section 55 and bottom dead center position data (feedback value) detected by the encoder 25.

The drive control signal is a drive current signal corresponding to each phase of the servomotor 33, and is substantially a torque instruction signal. A torque sensor 35 connected to the position control section 34 detects the load (torque) of the servomotor 33. The detection method may be a photoelectric method, a magnetic method, or the like.

A position detection section 60 includes a scale member 62 attached to the slide 15, a position sensor 61 that can detect the position of the slide (bottom surface) 15 based on the relative positional relationship between the position sensor 61 and the scale member 62 in the vertical direction, a reading circuit 64 that reads the position of the slide 15 detected by the position sensor 61, and a timing switch circuit 65 that generates a reading timing signal based on a signal that indicates the crank angle detected by the encoder 25, and outputs the reading timing signal.

A pair of scale members 62, a pair of position sensors 61, and a pair of reading circuits 64 are provided to calculate the slide position average value so that the accuracy and the reliability are further improved even when the slide 15 is slightly tilted in the forward/backward direction (i.e., the transverse direction in FIG. 1). Note that a pair of scale members 62, a pair of position sensors 61, and a pair of reading circuits 64 need not necessarily be provided (i.e., one scale member 62, one position sensor 61, and one reading circuit 64 may be provided on one side or at the center) depending on the guide structure and the rigidity of the slide 15 and the column 12, and the like.

Figure 3:
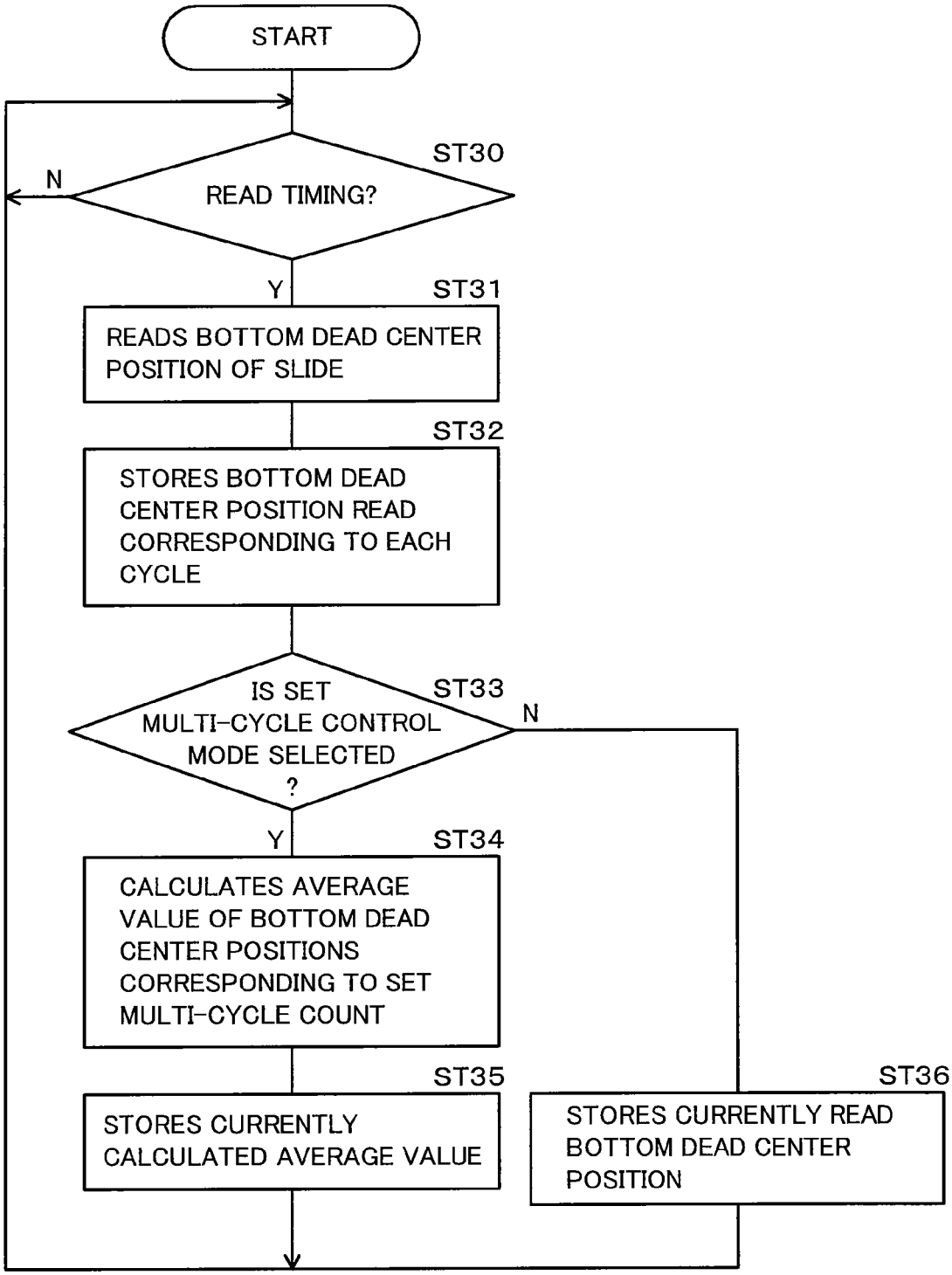
FIG. 3 is a flowchart illustrating an operation that calculates the average value of bottom dead center positions read corresponding to a cycle count.

The reading circuit 64 can read (detect) the bottom dead center position of the slide 15 by setting the crank angle of the timing switch circuit 65 at 180°, for example (YES in ST30 and ST31 in FIG. 3). The bottom dead center position that has been read (detected) corresponding to each cycle is stored in a memory section 53 (ST32).

When a single-cycle control mode Mt (described later in detail) has been selected (NO in ST33), the bottom dead center position read corresponding to the current cycle is stored in a control bottom dead center position storage area of the memory section 53 as the currently read bottom dead center position (ST36). Note that the currently read bottom dead center position is used as the precedingly read bottom dead center position (control bottom dead center position data) in a step ST15 in FIG. 2.

When a set multi-cycle control mode Mf (described later in detail) has been selected (YES in ST33 in FIG. 3), an average value calculation control section 51, 53 calculates the average value of the bottom dead center positions (including the currently read bottom dead center position) corresponding to the set multi-cycle count Nac that have been stored (ST32) (ST34). The currently calculated average value is stored in the control bottom dead center position storage area of the memory section 53 (ST35). Note that the currently calculated average value is used as the precedingly calculated average value (control bottom dead center position data) in a step ST17 in FIG. 2.

In FIG. 1, a drive control device 50 includes the control section 51 that includes a CPU, a clock circuit, and the like, the memory section 53 that includes a volatile memory (e.g., RAM) and a nonvolatile memory (e.g., ROM or HDD), the input/output section 55 that has a signal interface function, and the touch panel 57 that forms a setting input section and a display output section. The setting input section allows the worker to set and input various types of data. The display output section displays various types of data and a graph.

The bottom dead center position correction control section performs position correction control that corrects the actual bottom dead center position of the slide 15 to the target bottom dead center position while controlling the rotation of the adjustment motor 33 during a press operation. In this embodiment, the bottom dead center position correction control section includes the memory section 53 that stores a bottom dead center position correction control program, and the control section 51 that includes a CPU that executes the bottom dead center position correction control program.

A configuration relating to the technical features of the invention is described below.

The speed state determination section 51, 53 determines whether the actual press speed during a press operation is a changing state or a stable state. In this embodiment, the speed state determination section makes a determination (ST13 in FIG. 2) by comparing a calculated change rate (or change width) with a change rate (or change width) (i.e., reference value) set in advance.

The (calculated) change rate is calculated (ST12) by a change rate calculation control section 51, 53 using a precedingly detected SPM and a currently detected SPM. Each of the precedingly detected SPM and the currently detected SPM is not limited to a single value. For example, the change rate may be calculated using the average value of a plurality of values or the maximum value or the minimum value that represents a plurality of values. The detected SPM is detected by the encoder 25 (ST10), and is stored in the memory section 53 (ST11).

The change rate (or change width) is handled as an absolute value in the step ST13 (comparison and determination). When the determination result in the step ST13 is YES, the actual press speed is in a changing state (during acceleration or deceleration). When the determination result in the step ST13 is NO, the actual press speed is in a stable state. In this embodiment, the actual press speed is in a stable state during a continuous press operation at the set press speed (200 or 800 SPM).

The mode selection control section 51, 53 selects the single-cycle control mode Mt (ST14) when the speed state determination section 51, 53 has determined that the actual press speed is in a changing state (YES in ST13), and selects the set multi-cycle control mode Mf (ST16) when the speed state determination section 51, 53 has determined that the actual press speed is in a stable state (NO in ST13).

Figure 4:
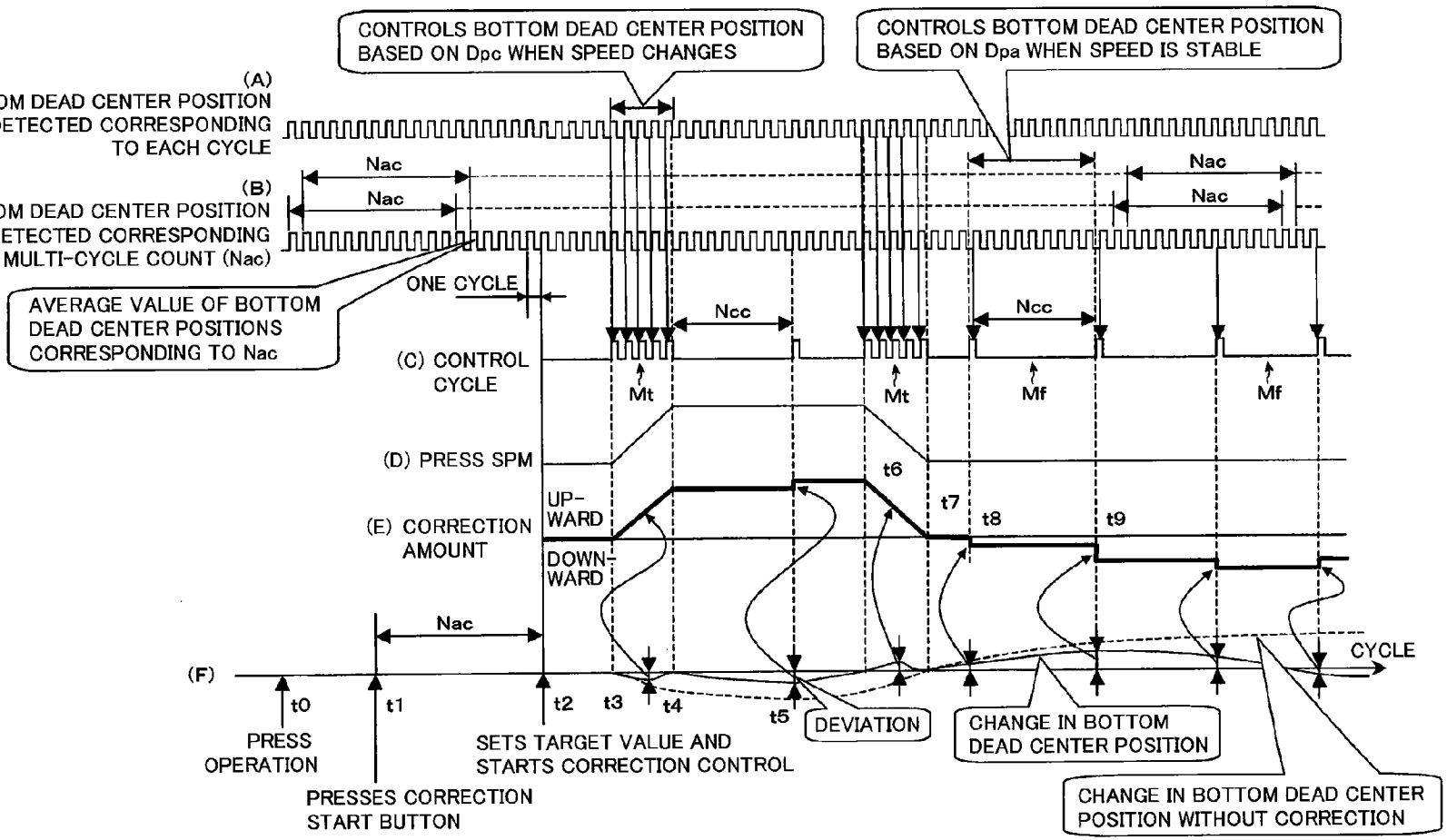

The single-cycle control mode Mt refers to a control mode in which the bottom dead center position correction control section performs position correction control corresponding to each press cycle (i.e., a single stroke of the slide 15), as illustrated at (C) in FIG. 4. The set multi-cycle control mode Mf refers to a control mode in which the bottom dead center position correction control section performs position correction control corresponding to the press multi-cycle count Ncc.

The bottom dead center position of the slide 15 generally changes to a large extent, as illustrated by a dashed line at (F) in FIG. 4, when the bottom dead center position correction control section does not perform position correction control. Specifically, the bottom dead center position of the slide 15 displaces downward (i.e., the die height decreases) during acceleration, and displaces upward (i.e., the die height increases) during deceleration.

Specifically, the bottom dead center position of the slide 15 displaces in a single direction (downward or upward) when the press speed is in a changing state (during acceleration or deceleration) (this phenomenon is not taken into consideration in the related art). Therefore, a problem that occurs in the related art (i.e., a hunting phenomenon that occurs when upward position correction control and downward position correction control are alternately repeated in a stable state) does not occur even when the bottom dead center position correction control section performs position correction control corresponding to each cycle when the press speed is in a changing state (single-cycle control mode Mt). Specifically, smooth and stable position correction control can be implemented.

On the other hand, when the press speed (e.g., 200 or 800 SPM) is in a stable state (set multi-cycle control mode Mf) and the bottom dead center position corresponding to each cycle is maintained constant, position correction control (single-cycle control) becomes an apparent disturbance factor due to a time delay (responsiveness and followability) of the control system (i.e., the entire system including the mechanical and electrical items) and the like. As a result, the bottom dead center position repeatedly changes to a large extent.

In the high-speed (e.g., 800 SPM) press machine 10 used in this embodiment, such a change in bottom dead center position is likely to occur to a large extent. Specifically, the single-cycle control mode Mt that is effective for a change in press speed in a single direction (during acceleration or deceleration) cannot ensure stable position correction control when the press speed is stable (stable state).

Therefore, the set multi-cycle control mode Mf is employed. In the set multi-cycle control mode Mf, the bottom dead center position correction control section performs position correction control corresponding to the control cycle count (a plurality of press cycles). The control multi-cycle count Ncc is set using the control cycle count setting section 57. The control multi-cycle count Ncc set using the control cycle count setting section 57 is stored in the memory section 53.

Figure 2:
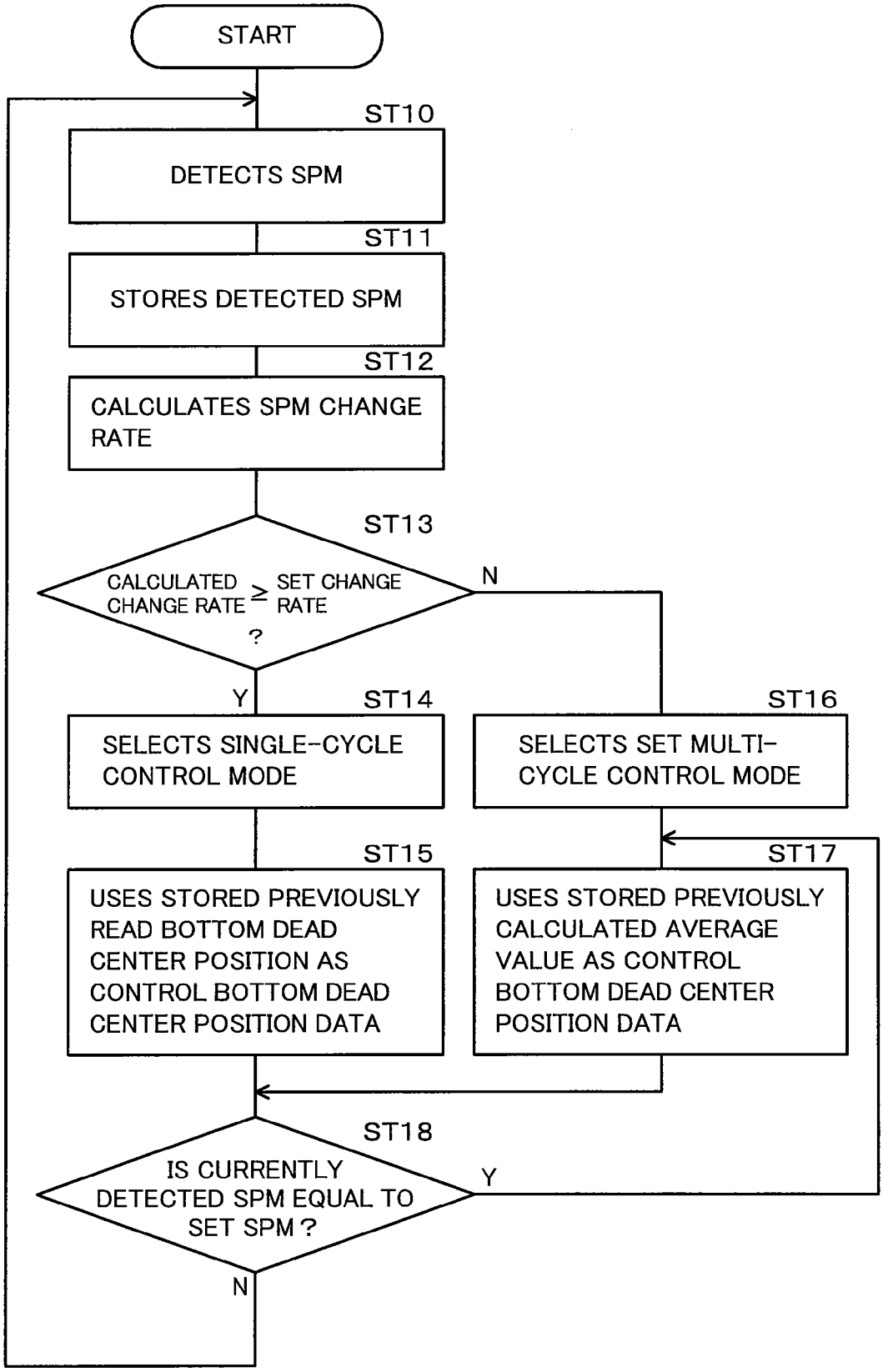
FIG. 2 is a flowchart illustrating a speed state determination operation and a mode selection operation.

The bottom dead center position correction control section 51, 53 performs position correction control corresponding to each cycle (ST15) when the single-cycle control mode Mt has been selected (ST14 in FIG. 2). The bottom dead center position correction control section 51, 53 performs position correction control corresponding to the control multi-cycle count Ncc set using the control cycle count setting section 57 (ST17) when the set multi-cycle control mode Mf has been selected (ST16).

In each control mode, the feedback amount (bottom dead center position) in the preceding control cycle is used as the feedback amount (bottom dead center position) in the current position correction control. However, when the press speed (bottom dead center position) is stable, an error (e.g., an error due to noise) in the bottom dead center position detected (read) in one cycle may become an apparent disturbance factor so that the subsequent control may become unstable.

Therefore, the bottom dead center position detected (read and stored) in the preceding cycle is used as control bottom dead center position data Dpc in the single-cycle control mode Mt (ST15), as illustrated in FIG. 2 and at (A) and (B) in FIG. 4. On the other hand, the calculated average value is used as control bottom dead center position data Dpa in the set multi-cycle control mode Mf (ST17). The average value calculation control section calculates the average value of the bottom dead center positions detected corresponding to the multi-cycle count Nac set using an average value calculation cycle count setting section 57 (ST34 in FIG. 3). The calculated average value is stored in the memory section 53 as the currently calculated average value (ST35).

The number (n) of bottom dead center positions (e.g., P1, P2, . . . , and Pn) detected corresponding to the set multi-cycle count Nac used to calculate the average value is identical. However, the bottom dead center positions (e.g., P1, P2, . . . , and Pn) are updated with the bottom dead center positions (P2, P3, . . . , and Pn+1) shifted backward. Therefore, multi-cycle control can be performed more stably.

In this embodiment, the average value calculation cycle count setting section 57 also serves as the control cycle count setting section 57, and the average value calculation multi-cycle count Nac can be set to be equal to the control multi-cycle count Ncc. Therefore, an erroneous setting or an error in set value can be significantly reduced so that handling is significantly facilitated.

A torque limit control section 51, 53 is further provided. The torque limit control section 51, 53 performs torque limit control that is given priority over position correction control by the bottom dead center position correction control section 51, 53 when the torque (motor current) of the adjustment motor 33 detected using the torque sensor 35 is equal to or larger than a set torque (torque limit) in FIG. 5. This prevents a situation in which the slide position adjustment mechanism 30 is mechanically constrained by the press load so that the servomotor 33 and the like are overloaded. The mechanical constraint range is set around the bottom dead center position of the slide 15.

In this embodiment, when the worker has issued a press operation instruction at a time t0 (see (F) in FIG. 4) using the touch panel 57, the drive motor 23 is driven so that the slide drive mechanism 20 moves the slide 15 up and down by vertically moving the drive shafts (i.e., the upper drive shaft 27 and the lower drive shaft 28) in synchronization. The bottom dead center position Dpc of the slide 15 corresponding to each press cycle is then read and stored as illustrated at (A) in FIG. 4 (ST30 to ST32 in FIG. 3).

In this embodiment, the press speed may be in a stable state immediately after the worker has pressed a correction start button 57 at a time t1 to issue a position correction control instruction based on the relationship among the structure and the mass of the press machine 10 and the slide drive mechanism 20, the press startup time determined by the capacity of the drive motor 23 and the like, and the timing at which the worker issues the press operation instruction.

Therefore, the target value (target bottom dead center position data) is set to start the actual position correction control after the time corresponding to the multi-cycle count Nac set in advance using the average value calculation cycle count setting section 57 has elapsed (time t2) after the worker has issued the press operation instruction, as illustrated at (F) in FIG. 4. Specifically, the period (time t1 to time t2) required to calculate the average value of the bottom dead center positions detected corresponding to the set multi-cycle count Nac is provided in case the set multi-cycle control mode Mf is selected (ST16 in FIG. 2).

The following description is given taking an example in which the press speed SPM (see (D) in FIG. 4) is set at 200 SPM in the first stage (time t2 to time t3), set at 800 SPM in the second stage (time t4 to time t6), and set at 200 SPM in the third stage (after time t7) for convenience of explanation. The period from the time t3 to the time t4 is an acceleration period, and the period from the time t6 to the time t7 is a deceleration period.

As illustrated in FIG. 2, the press speed SPM is detected and stored (ST10 and ST11). The operation time (time t2 to time t3) in the first stage (200 SPM) is shorter than the period of time corresponding to the set multi-cycle count Ncc (see (C) in FIG. 4). Since the bottom dead center position of the slide 15 is almost equal to the target bottom dead center position when the press speed is relatively low and constant (time t2 to time t3), position correction control is not performed.

The press speed is accelerated from 200 SPM to 800 SPM after the time t3. The change rate calculation control section 51, 53 calculates the change rate (ST12 in FIG. 2) using the precedingly detected SPM (200 SPM) and the currently detected SPM (e.g., 220 SPM).

The speed state determination section 51, 53 then determines whether the actual press speed is in a changing state or a stable state (ST13). The speed state determination section 51, 53 determines that the actual press speed is in a changing state in this stage (YES in ST13). Therefore, the mode selection control section 51, 53 selects the single-cycle control mode Mt (ST14).

When the mode selection control section 51, 53 has selected the single-cycle control mode Mt (ST14 in FIG. 2 and NO in ST33 in FIG. 3), the currently read bottom dead center position is stored (ST36 in FIG. 3), and used as the precedingly read bottom dead center position (i.e., the control bottom dead center position data Dpc), as illustrated at (A) in FIG. 4 (ST15 in FIG. 2).

The bottom dead center position correction control section 51, 53 performs position correction control corresponding to each press cycle, as illustrated at (A) and (C) in FIG. 4. Specifically, the bottom dead center position correction control section 51, 53 performs position correction control that corrects the actual bottom dead center position of the slide 15 to the target bottom dead center position while controlling the rotation of the adjustment motor 33 by utilizing the target bottom dead center position data and the bottom dead center position data detected during the press operation.

The upward correction amount of the slide 15 (see (E) in FIG. 4) increases proportionally to the press speed (see (D) in FIG. 4) as the press speed increases after the time t3. This is because the amount (thrusting amount) of change in bottom dead center position increases. For example, when the current press speed is 600 SPM, one cycle is short (0.1 seconds). However, since the bottom dead center position of the slide 15 is corrected in a single direction (upward), stable control is implemented.

Specifically, the actual bottom dead center position of the slide 15 can be corrected to the target bottom dead center position by performing position correction control that moves the slide position upward corresponding to each press cycle, as illustrated by a solid line at (F) in FIG. 4. The amount of change (deviation) in bottom dead center position can be significantly suppressed as compared with the case where position correction control is not performed (i.e., the amount of change in bottom dead center position in the downward direction gradually increases as illustrated by a dashed line). Therefore, a product can be produced during a period in which the press speed changes. Note that a product can also be produced at the press speed (200 SPM) in the first stage.

When the press speed has reached the set speed (800 SPM) at the time t4, the amount (thrusting amount) of change in the bottom dead center position of the slide 15 becomes constant so that the upward correction amount becomes constant, as illustrated at (E) in FIG. 4.

The speed state determination section 51, 53 then determines that the actual press speed is in a stable state (800 SPM) (NO in ST13 in FIG. 2). Therefore, the mode selection control section 51, 53 selects the set multi-cycle control mode Mf (ST16 and YES in ST33 in FIG. 3).

The average value calculation control section 51, 53 calculates the average value of the bottom dead center positions (including the currently read bottom dead center position) that have been detected corresponding to the set multi-cycle count Nac and stored (ST32) (ST34). The currently calculated average value is stored in the control bottom dead center position storage area of the memory section 53 (ST35). The currently calculated average value corresponding to the set multi-cycle count Nac is used as the precedingly calculated average value (i.e., the control bottom dead center position data Dpa), as illustrated at (B) in FIG. 4 (ST17 in FIG. 2).

The bottom dead center position correction control section 51, 53 performs position correction control corresponding to the set control multi-cycle count Ncc. In this embodiment, the set control multi-cycle count Ncc is the same as the average value calculation multi-cycle count Nac.

Since the press speed is set at 800 SPM (about 13 SPS), when the set multi-cycle count Ncc (=Nac) is set at 80, the bottom dead center position correction control section 51, 53 performs position correction control every 80 cycles (about 6 seconds=80/13). Therefore, a time delay that occurs in the related-art example in which position correction control is performed about every 0.08 seconds (=1/13) can be prevented. Specifically, a frequent hunting phenomenon can be prevented.

Moreover, since the feedback amount Dpa is the average value of the bottom dead center positions detected corresponding to the set multi-cycle count (Nac=80), the reliability of the feedback amount Dpa is significantly higher than that of the bottom dead center position detected corresponding to each cycle (i.e., the bottom dead center position is easily affected by a disturbance and may involve an error). Therefore, when a change in bottom dead center position due to a change in temperature (that is the same as a change in bottom dead center position illustrated at (F) in FIG. 4) is small (may be absent), the calculated average value changes to only a small extent and may be almost equal to the target bottom dead center position. The deviation decreases significantly as illustrated by a solid line. Specifically, position correction control becomes very stable when the press speed is in a stable state.

Since the press speed is in a stable state when the currently detected SPM (800 SPM) is equal to the set SPM (YES in ST18 in FIG. 2), position correction control is continuously performed using the previously calculated average value (ST17). Although (C) in FIG. 4 indicates that position correction control corresponding to the period (time t4 to time t5) equivalent to the control multi-cycle count Ncc is performed once, position correction control is performed a plurality of times during the actual press operation.

When the operation at the maximum SPM (800 SPM) has ended and the deceleration step (time t6 to time t7) in the third stage (200 SPM) has occurred, a value (e.g., 750 SPM) equal to or smaller than the maximum SPM (800 SPM) is detected (NO in ST18). Therefore, the calculated change rate is higher than the set change rate (ST10 to ST12 and YES in ST13). As a result, the single-cycle control mode Mt is selected (ST14) so that single-cycle position correction control (see (C) in FIG. 4) is performed (ST15).

When the press speed gradually decreases, the amount (thrusting amount) of change in bottom dead center position decreases proportionally to the press speed. Specifically, the upward correction amount of the slide 15 decreases proportionally to the press speed, as illustrated at (E) in FIG. 4. Therefore, the actual bottom dead center position of the slide 15 can be corrected to the target bottom dead center position by continuously performing position correction control that moves the slide position upward corresponding to each press cycle during the deceleration operation, as illustrated by a solid line at (F) in FIG. 4. Specifically, a product can be produced even when the press speed changes (during deceleration) as compared with the case where position correction control is not performed (i.e., the amount of change in bottom dead center position in the downward direction decreases but still exists as illustrated by a dashed line).

When the press speed has reached the set speed (200 SPM) in the third stage (after the time t7), the amount (thrusting amount) of change in the bottom dead center position of the slide 15 significantly decreases. Therefore, the bottom dead center position of the slide 15 tends to displace upward. In this case, position correction control is performed so that the bottom dead center position of the slide 15 moves downward, as illustrated at (E) in FIG. 4.

Specifically, the speed state determination section 51, 53 determines that the press speed is in a stable state (NO in ST13 in FIG. 2), and the mode selection control section 51, 53 again selects the set multi-cycle control mode Mf (YES in ST33 in FIG. 3).

The average value calculation control section 51, 53 calculates the average value of the bottom dead center positions (including the currently read bottom dead center position) that have been detected corresponding to the set multi-cycle count Nac and stored (ST32) (ST34). The currently calculated average value is stored in the control bottom dead center position storage area of the memory section 53 (ST35). The currently calculated average value is used as the precedingly calculated average value (i.e., the control bottom dead center position data) (ST17 in FIG. 2).

The bottom dead center position correction control section 51, 53 then performs position correction control corresponding to the set multi-cycle count Ncc.

Since the press speed is set at 200 SPM (about 3 SPS), when the set multi-cycle count Ncc (=Nac) is set at the same value 80 as the value set when the press speed is set at 800 SPM, the bottom dead center position correction control section 51, 53 performs position correction control every 80 cycles (about 27 seconds=80/3). Therefore, a time delay that occurs in the related-art example in which position correction control is performed about every 0.08 seconds (=1/13) can be prevented.

Moreover, since the feedback amount Dpa is the average value of the bottom dead center positions detected corresponding to the set multi-cycle count (Nac=80), the reliability of the feedback amount Dpa is high. Therefore, when a change in bottom dead center position due to a change in temperature (that is the same as a change in bottom dead center position in FIG. 4) is small (may be absent), the calculated average value changes to only a small extent and may be almost equal to the target bottom dead center position. Therefore, the deviation significantly decreases as illustrated by a solid line in FIG. 4. Specifically, position correction control becomes very stable when the press speed is in a stable state.

Since the press speed is in a stable state when the currently detected SPM is equal to the set SPM (200 SPM) (YES in ST18 in FIG. 2), position correction control is continuously performed using the previously calculated average value (ST17). When the operation at a press speed of 200 SPM is performed for a long time, the downward correction amount may increase when a change (decrease) in temperature or the like occurs.

According to this embodiment, since the bottom dead center position correction control section 51, 53 can perform position correction control corresponding to each press cycle when the single-cycle control mode has been selected by cooperation of the speed state determination section 51, 53 and the mode selection control section 51, 53 and can perform position correction control corresponding to the multi-cycle count Ncc set using the control cycle count setting section when the set multi-cycle control mode has been selected by cooperation of the speed state determination section 51, 53 and the mode selection control section 51, 53, position correction control that corrects the bottom dead center position of the slide 15 can be stably performed irrespective of whether the press speed is in a changing state or a stable state. Therefore, a highly accurate press product can be smoothly and efficiently produced while minimizing a change in bottom dead center position.

Since the bottom dead center position detected corresponding to the preceding cycle is used as the bottom dead center position data in the single-cycle control mode Mt and the average value of the bottom dead center positions detected corresponding to the set multi-cycle count Nac is used as the bottom dead center position data in the set multi-cycle control mode Mf, the control responsiveness when the press speed is in a changing state can be ensured while further improving the control stability when the press speed is in a stable state.

Since the average value calculation cycle count setting section 57 also serves as the control cycle count setting section 57 and the average value calculation multi-cycle count Nac can be set to be equal to the control multi-cycle count Ncc, handling is further facilitated during the actual operation.

Moreover, a situation in which an overload state occurs due to mechanical constraint by the press load can be prevented by the function of the torque limit control section 51, 53.

Furthermore, since the position of the lower drive shaft 28 with respect to the upper drive shaft 27 can be changed by the slide position adjustment mechanism 30 even when the drive shaft (i.e., the upper drive shaft 27 and the lower drive shaft 28) is moved up and down by the crank mechanism 21 so that the amount of adjustment can be added to or subtracted from the slide position that depends on the crank mechanism 21, the bottom dead center position can be corrected accurately and smoothly without hindering the press operation.

The invention is particularly effective when it is desired to efficiently produce a high-quality product using a press machine that enables a high-speed operation.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. A method for a bottom dead center position correction for a press machine, the press machine including a bottom dead center position correction control section, the bottom dead center position correction control section performing position correction control that corrects an actual bottom dead center position of a slide to a target bottom dead center position while controlling rotation of an adjustment motor by utilizing target bottom dead center position data and bottom dead center position data detected during a press operation, the method comprising the steps of:

determining, by a speed state determination section, whether an actual press speed is in a changing state or a stable state;

setting, with a control cycle count setting section, a control multi-cycle count;

selecting, with a mode selection control section, a control mode, comprising the steps of:

selecting a single-cycle control mode when the actual press speed is in a changing state; and selecting a set multi-cycle control mode when the actual press speed is in a stable state; and performing, with the bottom dead center position correction control section, a position correction, comprising the steps of:

performing position correction corresponding to each press cycle when the single-cycle control mode has been selected; and performing position correction corresponding to each multi-cycle count when the set multi-cycle control mode has been selected.

2. The method according to claim 1, further comprising the steps of:

setting, with an average value calculation cycle count setting section, an average value calculation multi-cycle count;

using a bottom dead center position detected in a preceding cycle as the bottom dead center position data in the single-cycle control mode; and using an average value of bottom dead center positions detected corresponding to the average value calculation multi-cycle count set by the average value calculation cycle count setting section as the bottom dead center position data in the set multi-cycle control mode.

3. The method according to claim 2, wherein the average value calculation cycle count setting section also serves as the control cycle count setting section; and further comprising the step of equating the average value calculation multi-cycle count to the control multi-cycle count.

4. The method according to claim 2, further comprising the steps of:

detecting a torque of the adjustment motor using a torque sensor; and comparing the detected torque of the adjustment motor to a set torque;

prioritizing torque limit control over the position correction control by the bottom dead center position correction control section when the detected torque is equal to or larger than the set torque.

* * * * *